United States Patent [19]

Cole

[11] 4,113,032

[45] Sep. 12, 1978

[54] MOTOR GRADER WITH DRAW BAR AND CIRCLE SUPPORT STRUCTURE

[75] Inventor: Carroll Richard Cole, Decatur, Ill.

[73] Assignee: Caterpillar Tractor Co., Peoria, Ill.

[21] Appl. No.: 735,245

[22] Filed: Oct. 26, 1976

[51] Int. Cl.[2] ..... E02F 3/76

[52] U.S. Cl. ..... 172/781

[58] Field of Search ..... 172/781, 782, 788, 789, 172/791, 792, 793, 794, 795, 796, 797; 52/729, 731

[56] References Cited

U.S. PATENT DOCUMENTS

| | | | |
|---|---|---|---|
| 2,128,881 | 8/1938 | Iverson | 172/797 |
| 2,646,633 | 7/1953 | Jahn | 172/782 |
| 3,101,819 | 8/1963 | Shinn | 52/731 |
| 3,470,967 | 10/1969 | Page et al. | 172/793 |
| 3,548,955 | 12/1970 | Hart | 172/793 |
| 3,722,864 | 3/1973 | Borer et al. | 52/731 X |

*Primary Examiner*—Richard T. Stouffer

*Attorney, Agent, or Firm*—Wegner, Stellman, McCord, Wiles & Wood

[57] ABSTRACT

A motor grader is provided with a unitary circle drawbar and circle mounting structure in which the drawbar is a box-like beam which increases in width from front to rear, with the rearward portions of the beam top and side plates forming the forward part of the circle mounting structure which also serves as an integral circle drive housing that is fully enclosed except for a forward opening through which a driving connection is made with an internal gear on the circle. The rearward part of the circle mounting structure is semi-annular, is a hollow rectangle in cross-section with an external top flange, and has its front end integrally connected to the drive housing with the lower part of which is defines an outwardly open annular channel in which the circle is rotatably supported.

18 Claims, 8 Drawing Figures

Fig-1.
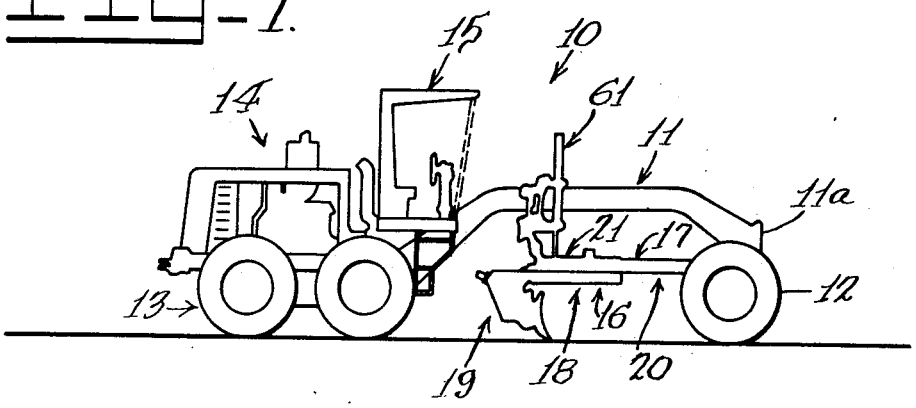
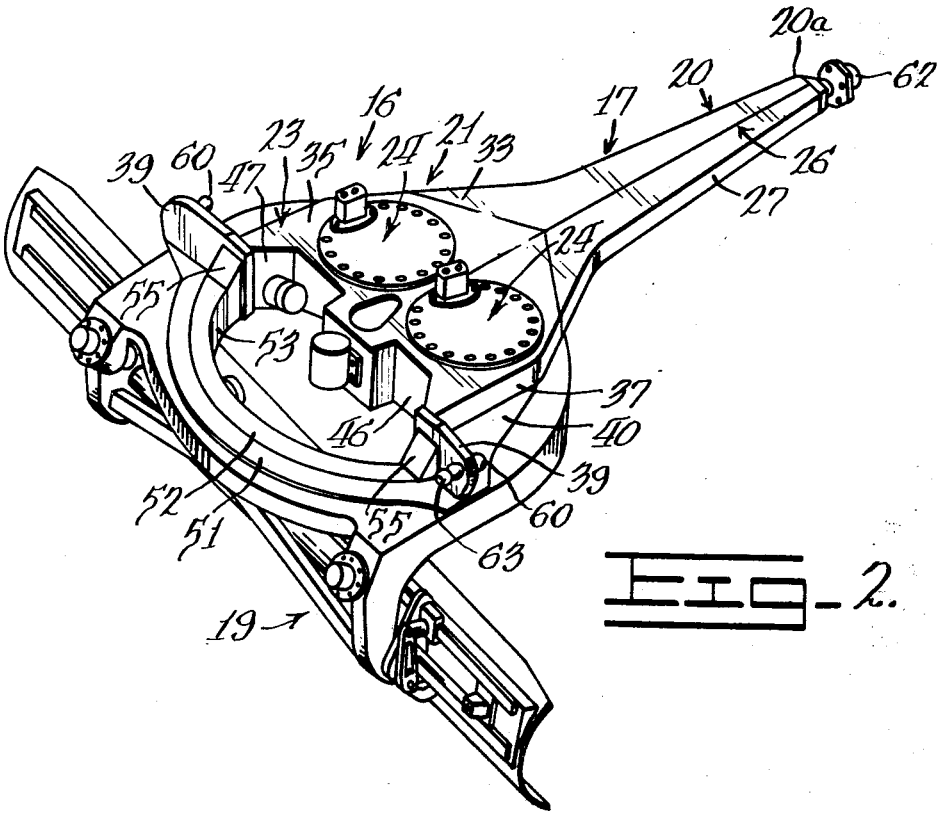
Fig-2.

20
26a
26b
26
34
34
33
35
42
24
8.
22
24
23
21
41
60
38
44
58
59
58
59
40
37
60
43
4.
4.
39
39
55
55
53
48
49
7.
52
51
18
7.
C
63

MOTOR GRADER WITH DRAW BAR AND CIRCLE SUPPORT STRUCTURE

CROSS-REFERENCE TO RELATED APPLICATIONS

The structure of the circle drawbar of this application is claimed in detail in applicant's copending U.S. Pat. application Ser. No. 661,880, filed Feb. 27, 1976 and issued Dec. 27, 1977 as U.S. Pat. No. 4,064,947; and the circle mounting structure of this application is claimed in detail in its relationship to the circle member and the internal gear in applicant's copending U.S. Pat. application Ser. No. 663,594, filed Mar. 3, 1976, and issued Apr. 15, 1977 as U.S. Pat. No. 4,015,669. The circle drive which is disclosed generally in this application is disclosed in detail and claimed in applicant's copending U.S. Pat. application Ser. No. 696,020, filed June 14, 1976.

BACKGROUND OF THE INVENTION

Motor garders have a longitudinal main frame which has a dirigible wheel assembly at its forward end, an operator's cab at its rearward end portion, and a traction chassis for the motor and power train behind the cab. The motor grader blade is suspended from the main frame by means of a circle draw bar and a circle. The circle draw bar has its front end connected to the front of the main frame by a ball and socket connection, while the rearward portion of the circle draw bar is suspended from the main frme by hydraulic cylinder and piston means which permit the draw bar to swing in a vertical plane about its front end.

The circle is mounted on the rearward portion of the circle draw bar for rotation about a vertical axis, and there is a driving interconnection between a motor on the circle draw bar and a ring gear on the circle to effect such rotary motion of the circle.

The grader blade is mounted upon the circle so that rotation of the circle changes the angle of the blade with reference to the path of travel of the grader, while swinging the circle draw bar in a vertical plane about its forward end changes the vertical position of the grader blade with reference to the ground.

In addition, the grader blade is mounted on a horizontal axis so that it may be tipped with respect to the circle by hydraulic cylinder and piston means to change the angle of attack of the blade.

Different types of circle draw bar and circle structures are illustrated in U.S. Pat. Nos. 2,497,778, 3,421,589, and 3,470,967. A type of grader structure in which the grader is towed behind a tractor instead of being at the front of a long grader vehicle, but which has a similar grader blade mounting, is illustrated in U.S. Pat. No. 2,498,044.

Typical grading operations place enormous stresses upon the circle draw bar, the circle and related parts of a motor grader. In operation the grader blade produces both vertical and lateral stresses in the entire system, and the direction and magnitude of those stresses varies depending upon the particular type of work being performed. Accordingly, it is difficult to engineer a grader blade mounting system which has adequate stress resistance without using excessively heavy components that increase grader cost and energy requirements.

SUMMARY OF THE INVENTION

The principal object of the present invention is to provide a unitary drawbar and circle mounting structure which are relatively light weight, but which provide great strength to resist the strains placed upon them when the grader is in use.

Another object of the invention is to provide an integral drawbar and circle mounting structure in which the top plate and side plates of a drawbar which is box-like in cross section are extended rearwardly to form the forward portion of the circle mounting structure.

Still another object of the invention is to provide an integral circle drawbar and circle mounting structure which incorporates a drive housing that defines the forward portion of a circle mounting structure in which the circle is supported entirely below the plane of the drawbar bottom plate.

Still a further object of the invention is to provide an apparatus which consists principally of integrally joined plates that define a plurality of rigidly interconnected elements, most of which are box-like in cross section for maximum strength with light weight.

THE DRAWINGS

FIG. 1 is a side elevational view of a motor grader embodying the invention;

FIG. 2 is a perspective view of a subassembly consisting of a circle drawbar, a circle, and a grader blade in which the circle drawbar embodies the present invention;

DETAILED DESCRIPTION OF THE INVENTION

Referring first to FIG. 1 of the drawings, a motor grader, indicated generally at 10, includes a longitudinal main frame 11 the front end **11*a* of which is supported upon a dirigible front wheel assembly 12, and the rear end of which constitutes part of a traction chassis, indicated generally at 13, on which is mounted a power plant, indicated generally at 14. An operator's cab, indicated generally at 15, is on the rear portion of the main frame, forward of the traction chassis. A grader blade subassembly, indicated generally at 16, consists generally of a circle mounting bar, indicated generally at 17, which in the illustrated apparatus is a draw bar; a circle structure, indicated generally at 18; and a grader blade and blade mounting, indicated generally at 19**.

Figure 8:
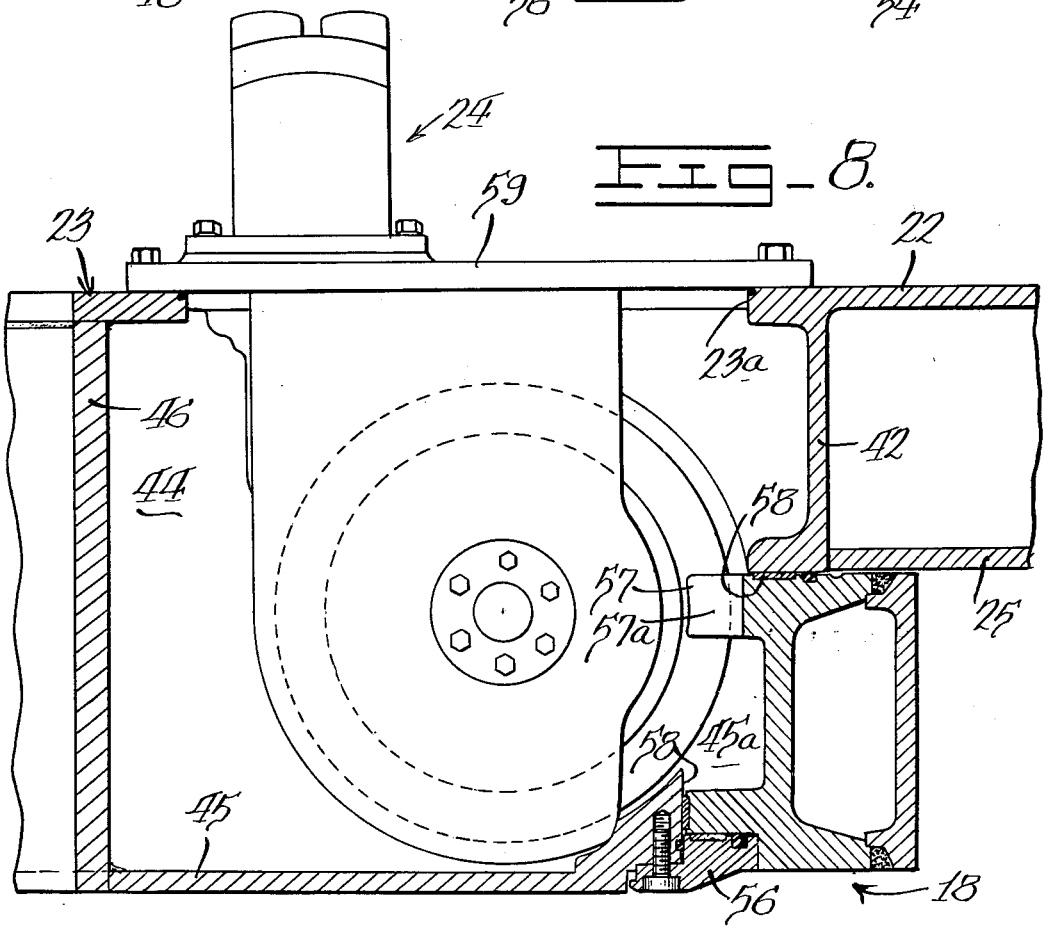
FIG. 8 is a fragmentary sectional view on a scale which is half that of FIG. 7 taken substantially as indicated along the line 8—8 of FIG. 3.

Referring now to FIG. 2, the circle drawbar 17 includes a box-like drawbar beam, indicated generally at 20, and a rearward circle mounting structure, indicated generally at 21, the forward part 22 of which is integral with the rear end of the box-like drawbar beam 20. At the rear of the part 22 of the mounting structure, and formed integrally therewith, is a drive housing 23 which is best seen in FIG. 8 to be about twice the depth of the box-like drawbar beam 20. The drive housing 23 receives drive means consisting of two identical circle drive means structures, indicated generally at 24.

Figure 3:
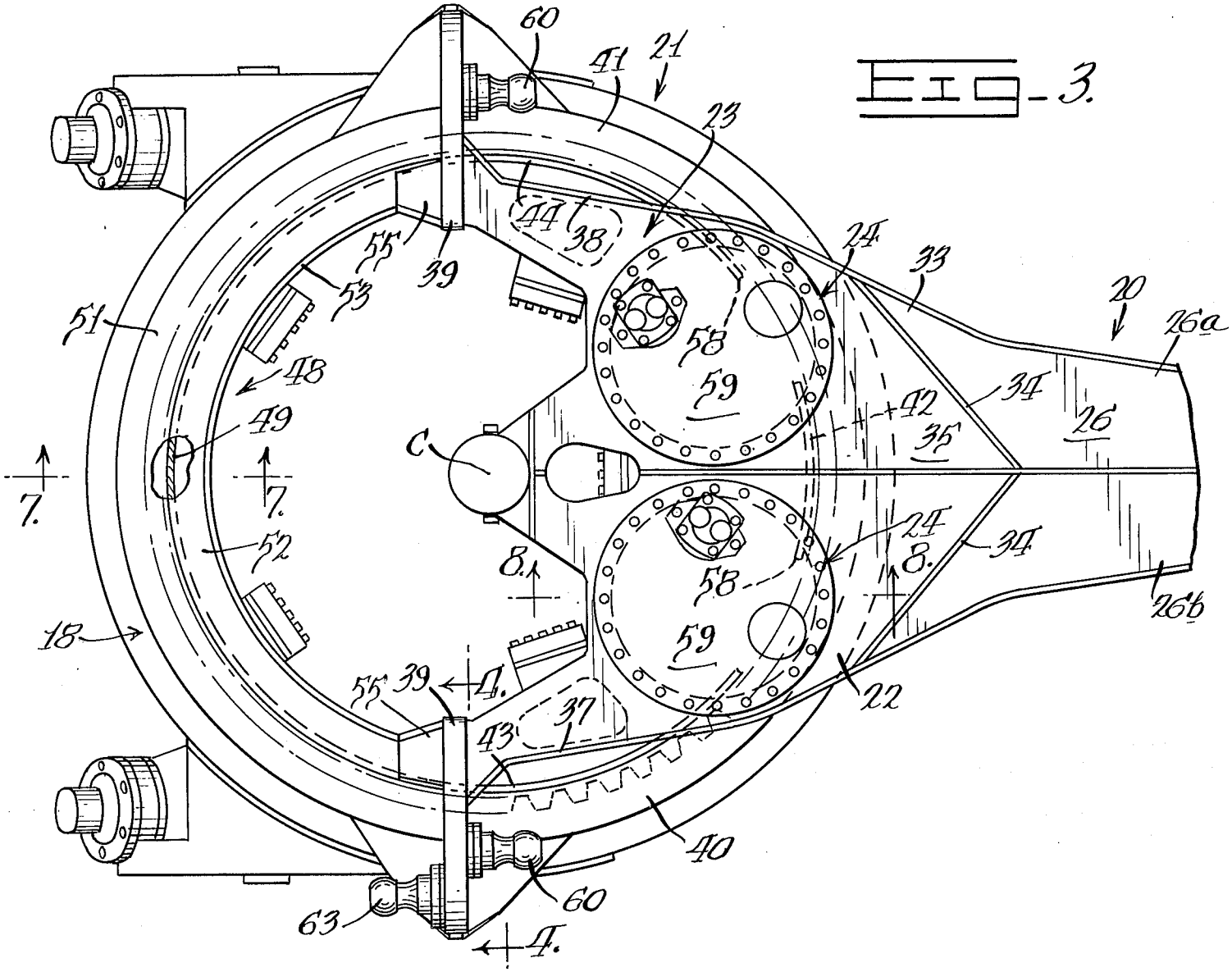
FIG. 3 is a fragmentary plan view on an enlarged scale, illustrating the circle mounting structure and the rearward portion of the circle drawbar.
Figure 4:
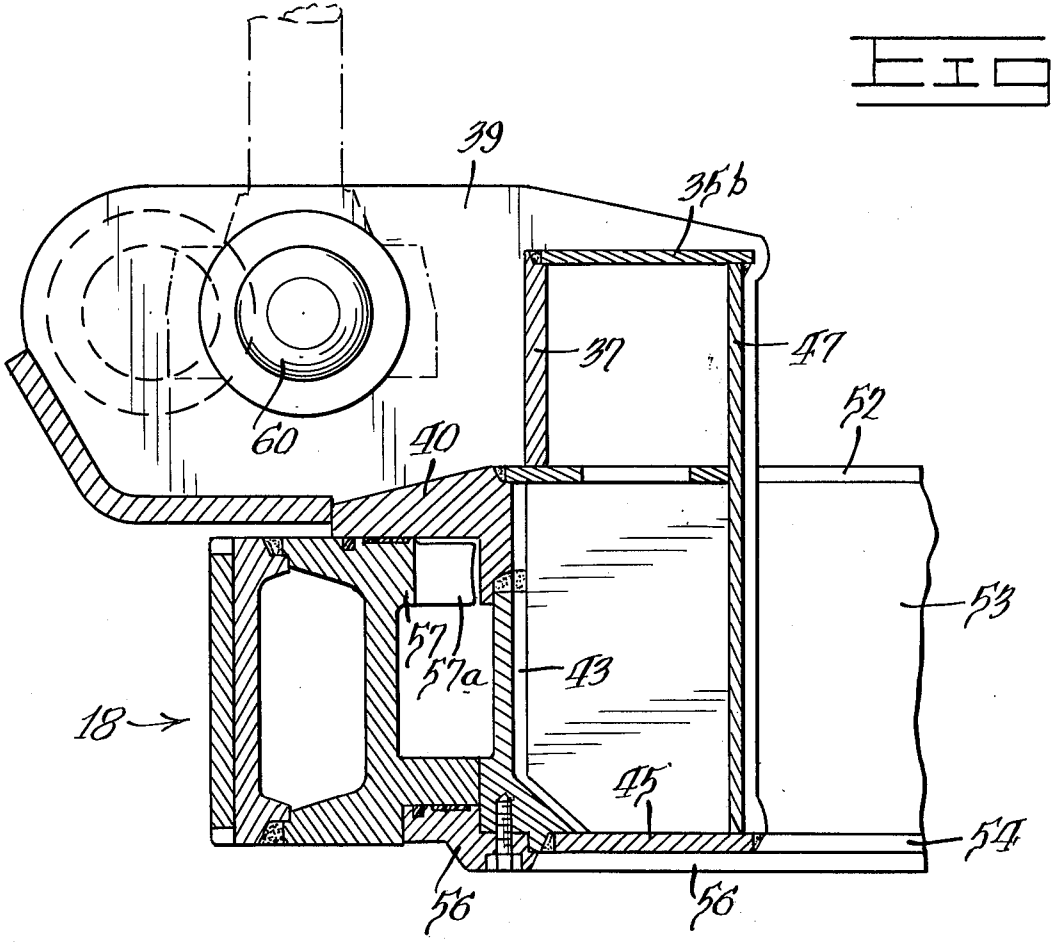
FIG. 4 is a fragmentary sectional view on an enlarged scale taken substantially as indicated along the line 4—4 of FIG. 3, with the lower end portion of the rod of a suspension ram illustrated in broken line.
Figure 5:
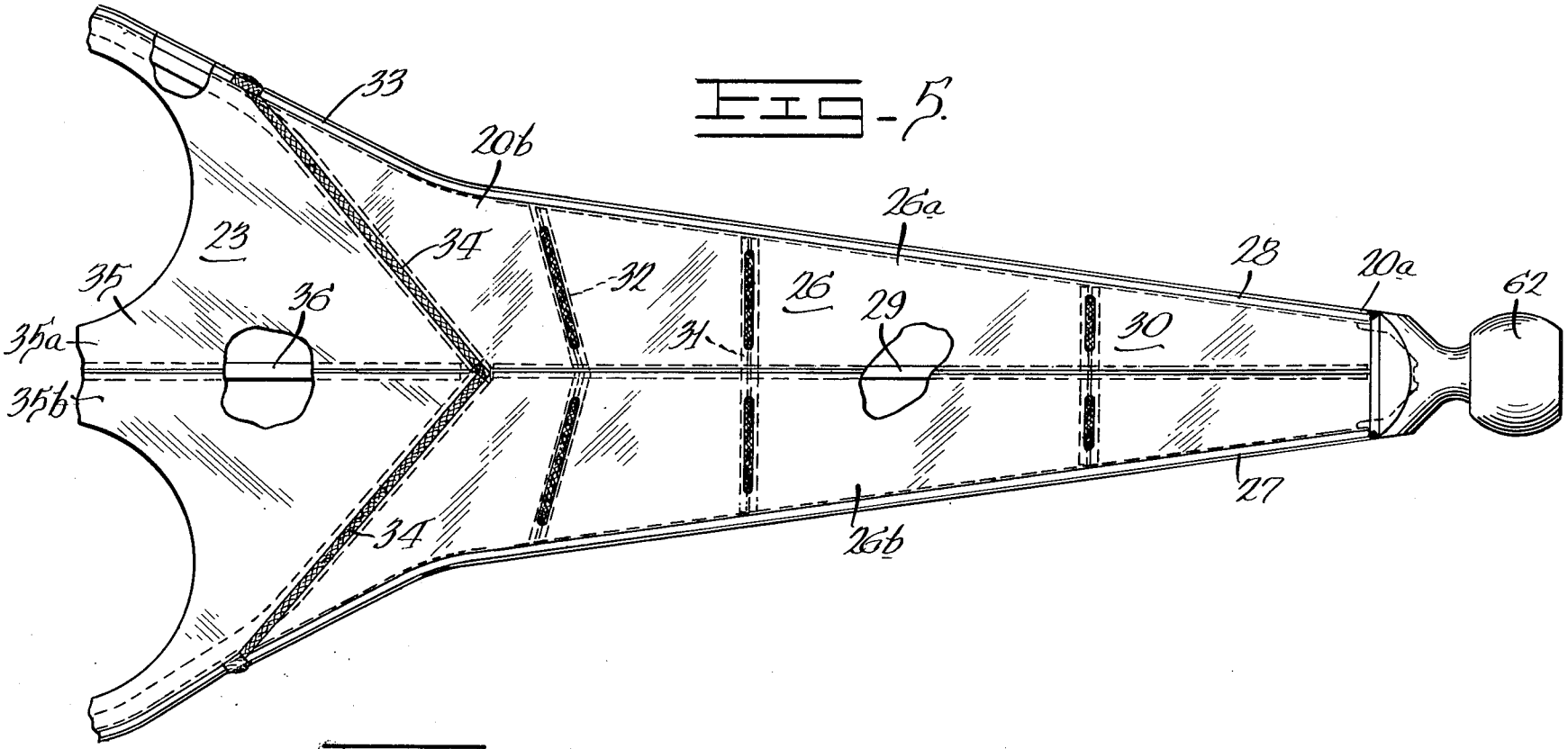
FIG. 5 is a plan view of the forward portion of the circle mounting structure and the circle drawbar on a scale larger than that of FIG. 3.
Figure 6:
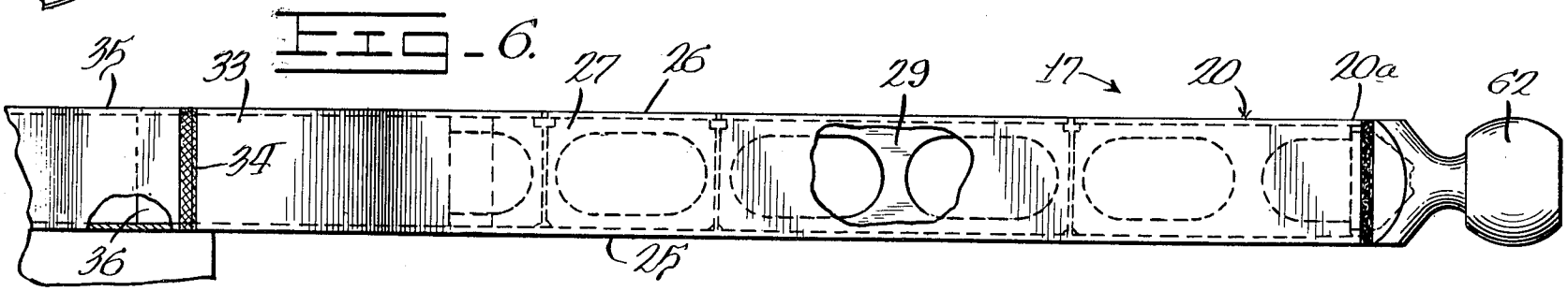
FIG. 6 is a fragmentary side elevational view of that portion of the structure illustrated in FIG. 3.

Referring now particularly to FIGS. 3 to 5, the box-like drawbar beam 20 is seen to include a bottom plate 25, a top plate 26, and side plates 27 and 28, together with an upright longitudinal reinforcing web 29 and upright transverse reinforcing webs 30, 31 and 32. The drawbar beam 20 increases in width from a forward end 20*a* to a rearward end 20*b*; and at the extreme rearward end the beam flares laterally as seen at 33 where it joins with the forward portion 22 of the circle mounting structure 21. The rear end of the top plate 26 is welded to upright internal webs 34 and to a top plate 35 which forms a rearward extension of the plate 26 and defines the top wall of the drive housing 23. As a matter of manufacturing convenience, the drawbar beam top and bottom plates 25 and 26 are formed in two halves, such as the halves 26*a* and 26*b* seen in FIG. 5; and the rearward extension 35 of the top plate 26 is also formed of two sections 35*a* and 35*b*. An upright web 36 extends rearwardly from the connecting ends of the diagonal webs 34 in line with the web 29, and terminates at the front of the housing 23.

In addition to the housing 23, the circle mounting structure 21 includes side plates 37 and 38 which are further extensions of the drawbar beam side plates 27 and 28; and those rearward extensions 37 and 38 terminate at aligned, laterally extending upright plates 39; and extending laterally outwardly from the side plate extensions 37 and 38 are horizontal webs 40 and 41 on the ends of which the laterally extending upright plates are welded. In addition to the rearward extension 35 of the draw-bar beam top plate 26, which forms the top wall of the drive housing 23, the housing is defined by an upright, arcuate forward wall 42 which extends around to the upright plates 39 as seen at 43 and 44. The upright wall 42-43-44 forms an arc of a circle struck about the center of rotation C of the circle structure 18; and the forward parts of the upright wall define the front of the drive housing 23. Further, as best seen in FIGS. 4 and 8 the upright wall 42-43-44 extends below the plane of the bottom wall 25 of the drawbar beam 20; and the drive housing 23 is completed by a bottom wall 45 and transverse upright wall means 46 which is welded to the top wall 35 and the bottom wall 45 and which is best seen in FIGS. 2 to 4 to have its lateral extremities integrally joined to upright connecting plates 47 which are also welded to the laterally extending upright plates 39 and to the top plate 35 and the bottom wall 45 to define box-like structures.

Figure 7:
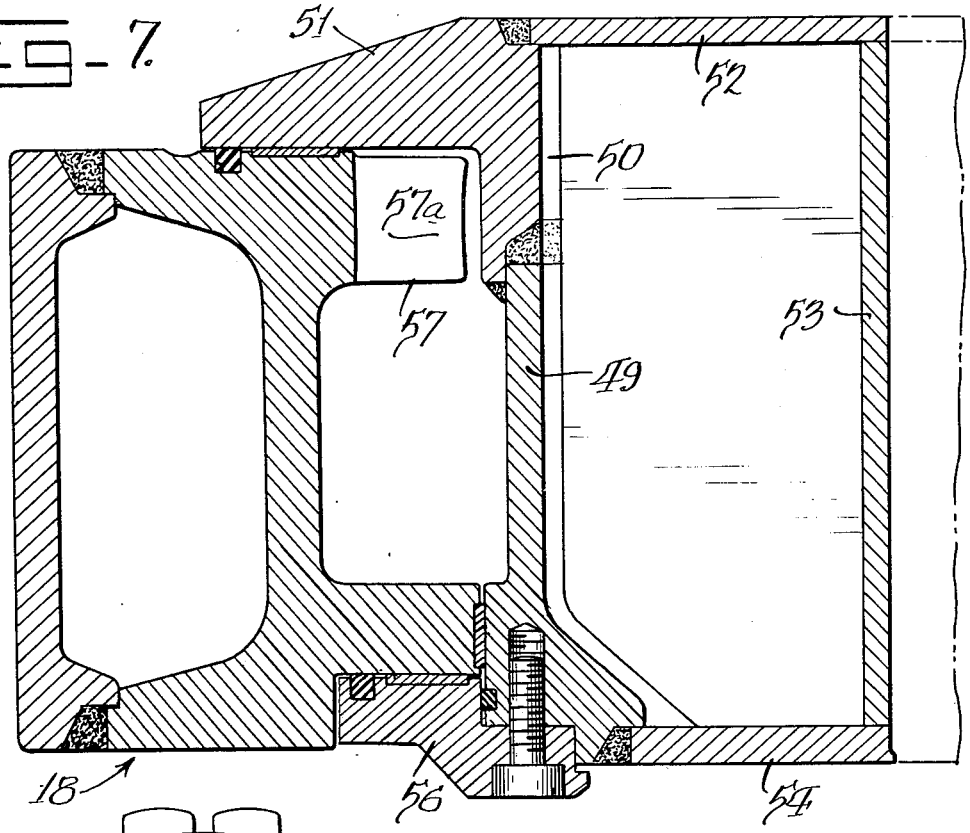
FIG. 7 is a fragmentary sectional view on an enlarged scale taken substantially as indicated along the line 7—7 of FIG. 3.

The circle mounting structure 21 also has a rearward portion 48 which is best seen in FIGS. 3 and 7 to consist of a semiannular wall 49 which is a segment of a circle struck about the center C and which has its forward extremities welded to the laterally extending upright plates 39 in alignment with the forward wall 42-43-44. Surmounting the upright semiannular wall 49 is a member 50 which is seen in FIG. 7 to be angular in cross section so as to provide a radially outwardly extending web 51 the inner periphery of which is connected to a radially inwardly extending web 52. The web 51 also has its forward extremities welded to the upright plates 39 in alignment with the rear extremities of the webs 40 and 41, so that functionally it acts as a continuation of said webs around the rearward portion 48 of the circle mounting structure.

Positioned radially inwardly from the semiannular wall 49 is another semiannular wall 53 the upper end of which is welded to the radially inwardly extending web 52 and the bottom of which is welded to a bottom wall 54; and the web 52, the upright wall 53 and the bottom wall 54 are all welded at their forward extremities to the laterally extending upright plates 39. Hollow bracing structures 55 are at the rear of the upright plates 39 and connect to the radially inwardly extending web 52.

Details of the circle structure 18 and of its precise structural relationship with the circle mounting structure 21 are described and claimed in my co-pending application Ser. No. 663,594, previously referred to herein, and accordingly such details are not repeated here. However, for the sake of completeness reference is made to FIGS. 7 and 8 which show an annular bottom flange 56 which is detachably connected to the bottom of the semiannular wall 49 and to an upstanding lip 45*a* of the drive housing bottom wall 45, and which cooperates with the wall 49, the wall 42-43-44, and the webs 40-41-51 to form an outwardly open channel in which the circle structure 18 is rotatably mounted.

As seen in FIGS. 7 and 8 the circle structure 18 is also box-like in cross section and has an internal gear 57 provided with teeth 57*a* which extend into drive openings 58 in the upright front wall 42-43-44 into driving engagement with output elements of the two circle drive means structures 24. As seen in FIG. 8, the forward portion of the circle structure 18 is below the rearward part of the circle drawbar bottom plate 25.

The top wall 35 of the drive housing 23 is provided with circular openings 23*a* to receive the circle drive means structures 24, and said drive means structures include mounting plates 59 which close the openings 23*a*. The present application includes no detailed description of the circle drive means structures 24, inasmuch as such structures and the drive mechanism by means of which they drive the circle structure 18 are described in detail and claimed in my co-pending application Ser. No. 696,020, previously referred to.

The laterally extending upright plates 39 serve as integral parts of the unitary drawbar and circle mounting structure and also provide mountings are forwardly extending balls 60 that make ball and socket connections with fittings (not shown) on the lower ends of a pair of hydraulic rams 61 which are carried upon the main frame 11. At the front of the drawbar beam 20 is a ball 62 which forms part of a ball and socket connection (not shown) by means of which the front of the sub-assembly 16 is connected for universal movement on the front end 11a of the main frame. Thus, operation of the hydraulic rams 61 swings the sub-assembly 16 about the ball and socket connection including the ball 62, which in this respect provides a horizontal pivot axis. In addition, a ball 63 on one of the upright plates 39 provides for a ball and socket connection with a side-shift cylinder (not shown) which shifts the sub-assembly sideways, with the ball 62 providing vertical pivot axis.

The foregoing detailed description is given for clearness of understanding only and no unnecessary limitations should be understood therefrom as modifications will be obvious to those skilled in the art.

What is claimed is:

1. In a motor grader which includes a circle member having an internal ring gear and a grader blade suspended beneath said circle member, a unitary drawbar and circle mounting structure comprising, in combination:

a box-like drawbar beam having top and bottom plates and side plates, said beam increasing in width from a connecting end toward a rearward circle mounting end;

an enclosed drive housing integral with the rear portion of said drawbar beam, said drive housing having a lower portion extending below the drawbar beam bottom plate and having an upright forward wall which is an arc of a circle struck about the center of rotation of the circle member;

and a rearward portion of said circle mounting structure which has its forward part integrally connected to said lower portion of the enclosed drive housing and which includes an upright arcuate wall that completes said circle struck about the center of rotation of the circle member so that said drive housing and said rearward portion cooperate to provide a mounting for the circle member below the plane of the drawbar beam bottom plate, and there being a drive opening in the lower portion of the drive housing forward wall.

2. The combination of claim 1 in which the drawbar beam top plate includes a rearward extension which forms the top of the drive housing.

3. The combination of claim 2 in which the drawbar beam side plates include rearward extensions at the sides of the drive housing and have their upper edges integrally connected to said rearward extension of the top plate.

4. The combination of claim 2 which includes generally transverse upright wall means defining the rear of the drive housing.

5. The combination of claim 4 which includes a bottom wall integrally connected to the lower margins of the forward wall and the transverse wall means to form the bottom of the drive housing.

6. The combination of claim 1 which includes a horizontal web that projects outwardly substantially in the plane of the drawbar beam bottom plate and forms an arc of a circle overlying and integral with the upright arcuate wall, said web extending radially outwardly from said arcuate wall and cooperating therewith to define a recess in which the circle member is mounted.

7. The combination of claim 6 in which the web also extends radially inwardly from the arcuate wall, there is an inner wall concentric with said arcuate wall which has its upper margin joined integrally to the web, and a lower wall joined integrally to said concentric walls to form a hollow structure which is generally rectangular in cross section.

8. The combination of claim 7 which includes aligned laterally extending upright plates surmounting the web which close the forward end of said hollow structure.

9. The combination of claim 6 which includes aligned laterally extending upright plates surmounting the web and joined integrally therewith and with the rearward portion of the drive housing.

10. The combination of claim 9 in which the drawbar beam side plates include rearward extensions at the sides of the drive housing and are joined integrally with said laterally extending upright plates.

11. The combination of claim 10 in which the drawbar beam top plate includes a rearward extension which forms the top of the drive housing and is joined integrally with said rearward extensions of the side plates.

12. The combination of claim 10 which includes upright connecting plates spaced inwardly from the rearward extensions of the side plates and integrally joined to the rear of the drive housing and to the laterally extending upright plates to define box-like structural elements.

13. The combination of claim 1 in which the drive housing includes a top plate provided with an opening, and which includes a circle drive means structure having a mounting plate which closes said opening.

14. In a motor grader which includes a circle member having an internal ring gear and a grader blade suspended beneath said circle member, a unitary drawbar and circle mounting structure comprising, in combination:

a box-like drawbar beam having top and bottom plates and said plates, said beam increasing in width from a connecting end toward a rearward circle mounting end, and said top plate and side plates extending rearwardly beyond said bottom plate to form the forward part of the circle mounting structure;

an upright arcuate forward wall connected to the top plate and to the rear end of the bottom plate between the rearward extensions of the side plates, said forward wall having a lower portion which is below the bottom plate and has a drive opening, and having a lower margin below a circle member which is entirely below the plane of the bottom plate;

upright, generally transverse intermediate wall means which is spaced rearwardly from the forward wall and has a lower margin coplanar with that of the forward wall;

a bottom wall connected peripherally to said lower margins of and cooperating with the forward wall and the intermediate wall means to define a drive housing which is encircled by the forward portion of the circle member;

and a generally semi-annular rearward portion of said circle mounting structure comprising an upright arcuate wall which has its forward extremities integrally connected to the lower portion of the drive housing, said rearward portion being principally below the plane of the bottom plate and having a lower margin coplanar with the bottom wall.

15. The combination of claim 14 which includes a horizontal web that projects outwardly substantially in the plane of the drawbar beam bottom plate and forms an arc of a circle overlying and integral with the upright arcuate wal, said web extending radially outwardly from said arcuate wall and cooperating therewith to define a recess in which the circle member is mounted.

16. The combination of claim 15 in which the web also extends radially inwardly from the arcuate wall, there is an inner wall concentric with said arcuate wall which has its upper margin joined integrally to the web, and a lower wall joined integrally to said concentric walls to form a hollow structure which is generally rectangular in cross section.

17. The combination of claim 16 which includes aligned laterally extending upright plates surmounting the web which close the forward end of said hollow structure.

18. The combination of claim 17 which includes upright connecting plates spaced inwardly from the rearward extensions of the side plates and integrally joined to the transverse intermediate wall means and to the laterally extending upright plates to define box-like structural elements.

* * * * *